United States Patent [19]

Stellaccio et al.

[11] Patent Number: 4,692,172

[45] Date of Patent: Sep. 8, 1987

[54] COAL GASIFICATION PROCESS

[75] Inventors: Robert J. Stellaccio, Spring, Tex.; Robert M. Suggitt, Wappingers Falls, N.Y.

[73] Assignee: Texaco Inc., White Plains, N.Y.

[21] Appl. No.: 827,858

[22] Filed: Feb. 10, 1986

Related U.S. Application Data

[63] Continuation of Ser. No. 632,351, Jul. 19, 1984, abandoned.

[51] Int. Cl.[4] ..... C10J 3/46

[52] U.S. Cl. ..... 48/197 R; 48/203; 48/206; 48/DIG. 2; 252/373

[58] Field of Search ..... 48/197 R, 203, 206, 48/DIG. 7, DIG. 2; 252/373

[56] References Cited

U.S. PATENT DOCUMENTS

| | | | |
|---|---|---|---|
| 1,799,885 | 4/1931 | Chavanne | 48/203 |
| 1,955,574 | 4/1934 | Benner et al. | 110/342 |
| 2,644,745 | 7/1953 | Hemminger | 48/203 |
| 4,277,365 | 7/1981 | Paull et al. | 252/373 |
| 4,400,180 | 8/1983 | Marion et al. | 252/373 |

OTHER PUBLICATIONS

Lowry, Chemistry of Coal Utilization, vol. 1, pp. 565–571, 1945.

*Primary Examiner*—Peter Kratz

*Attorney, Agent, or Firm*—Robert A. Kulason; James J. O'Loughlin; Albert Brent

[57] ABSTRACT

Low sulfur, iron and calcium containing solid carbonaceous fuel having a high melting point ash is mixed with a sufficient amount of iron sulfide containing material or supplemental iron and sulfur containing reactant materials that react in the reaction zone to produce iron and sulfur containing compounds. The mixture of materials is reacted in a free-flow gasifier by partial oxidation to produce a raw gas stream of synthesis gas, reducing gas or fuel gas, containing entrained particulate matter including molten slag. By the process, sufficient iron and sulfur are in the reaction zone so that the melting point of the fuel ash is decreased, and the mole ratio $H_2S/H_2+CO$ in the raw gas stream is greater than 0.01. Further, the amount of iron in the molten ash is greater than 10.0 wt. %, and preferably at least 14 wt. % of the molten ash. By this means, the fluid temperature of the molten ash entrained in the raw gas stream is reduced at least 100° F. less than the fluid temperature of the fuel ash without the addition of iron and sulfur, and the gasifier may be operated in the molten slagging mode at a lower temperature. Further, coal wash tailings containing iron sulfides may be disposed of as a portion of the feed to the gasifier in an environmentally acceptable manner; and useful by-product sulfur may be recovered.

19 Claims, No Drawings

COAL GASIFICATION PROCESS

This is a continuation of application Ser. No. 632,351, filed July 19, 1984, now abandoned.

FIELD OF THE INVENTION

This invention relates to the partial oxidation of solid carbonaceous fuel containing ash with a high melting or fusion temperature. More particularly, this invention relates to a method for lowering the ash melting temperature to factilitate the separation of ash from the effluent gas stream produced by the partial oxidation of solid carbonaceous fuels e.g. coal containing a low amount of sulfur, iron and calcium.

BACKGROUND OF THE INVENTION

When low sulfur coal containing iron or calcium in insufficient amounts is charged to a Texaco free-flow coal gasifier as feedstock for the production of synthesis gas, reducing gas, or fuel gas, the ash particles produced are characterized by an undesirably high melting or fusion temperature. The partial oxidation of coal slurries is described in coassigned U.S. Pat. No. 3,544,291, which is incorporated herein by reference. The reduction of the oxides of iron, copper, vanadium or barium, and the simultaneous production of carbon monoxide and hydrogen in an oil fired partial oxidation gas generator is described in coassigned U.S. Pat. No. 2,824,792.

When the gasifier is operated in the slagging mode, the temperature in the reaction zone is kept sufficiently high in order to melt the fine ash particles and thereby produce molten slag. In the molten form, slag may be more readily separated from the raw effluent gas stream and from the reaction chamber. In the case of solid carbonaceous fuels having relatively low iron, sulfur and calcium constituents, the gasifier must be operated at temperatures above 2700° F. in order to achieve the desired molten state of the slag. However, such temperatures are undesirable in that they may reduce refractory life. Furthermore, thermal efficiency suffers in that desirable synthesis gas product is burned to generate heat for melting the slag. Some examples of coals having low contents of sulfur, iron, and calcium are Lake Desmet coal and certain Australian coals, e.g., Moura coal and R. W. Miller coal.

It is an object of this invention to provide a novel process for the production of synthesis gas, reducing gas or fuel gas in a slagging-mode free-flow gasifier that operates at lower reaction temperatures than those ordinarily required for the partical oxidation of a solid carbonaceous fuel e.g. coal having a normally high ash melting or fusion temperature. It is also an object of this invention to use the iron sulfide contained in the waste products from coal washing processes to simultaneouly achieve a lowering of the coal ash fusion temperature in coal gasification, and for the environmentally acceptble disposal of coal cleaning waste products. Other objects will be apparent to those skilled in the art.

SUMMARY

Low sulfur, iron and calcium containing solid carbonaceous fuels e.g. coal containing less than about 2.0 wt. % sulfur, and with less than about 10.0 wt. % iron and less than about 8.0 wt. % calcium in the noncombustible portion of said solid carbonaceous fuel is mixed with a sufficient amount of iron sulfide containing material or supplemental iron and sulfur containing reactant materials that react in the reaction zone of the gas generator to produce iron and sulfur containing compounds. This feed mixture is suspended in a liquid or gaseous medium and reacted with a free-oxygen containing gas by partial oxidation in the slagging mode, e.g., at a temperature greater than about 2000° F. and high enough to keep the ash produced in the molten state. Preferably, the temperature in the reaction zone is below 2700° F. A hot raw effluent gas stream of synthesis gas, reducing gas or fuel gas is produced thereby substantially comprising $H_2$, CO, $CO_2$, $H_2S$, COS, entrained particulate matter, molten ash containing iron and sulfur containing compounds, and optionally at least one material from the group $H_2O$, $N_2$, Ar, and $NH_3$. In the process, sufficient supplemental iron and sulfur react in the free-flow reaction zone of the gas generator so that the melting point of the solid carbonaceous fuel ash is sufficiently lowered to facilitate removal from the hot raw effluent gas stream and from the reaction chamber, and the mole ratio $H_2S/H_2+CO$ in the raw gas stream is greater than 0.01, such as the range of about 0.015 to 0.05. Further, the amount of iron in the molten ash is greater than 10 wt. % of the molten ash, and preferably at least equivalent to 14 wt. % of the molten ash. By this means, the fluid temperature of the molten ash entrained in the raw gas stream is reduced about 100° F. or more, such as about 100° F. to 350° F., below the fluid temperature of the fuel ash without the addition of iron and sulfur. At least a portion of the particulate matter and molten ash are then separated from the raw gas stream. The $H_2S$ and COS formed in the reaction zone may be subsequently removed from the hot raw effluent gas stream during gas purification. By this process the melt point of the slag may be reduced so that the gasifier may be operated in the slagging mode at a lower temperature. Further, coal cleaning waste products, such as coal wash tailings containing iron sulfides may be mixed with the solid carbonaceous fuel and disposed of in an environmentally acceptable manner while useful by-product sulfur may be recovered.

DESCRIPTION OF THE INVENTION

The charge to the process of this invention includes solid carbonaceous fuels which are characterized by an ash having a high melting or fusion temperature. Typical of such fuels are coals including anthracite, bituminous, sub-bituminous, lignite, coke from coal, petroleum coke, soot, tar sand, asphalt, pitch, and mixtures thereof. The solid carbonaceous fuels which find particular use in practice of the process of this invention include those having an ash fluid temperature (AFT—as determined by ASTM Method D-1857) of above about 2500° F., and commonly 2600° F.–2800° F. or higher.

These solid carbonaceous fuel feedstocks are also characterized by:

(i) a low sulfur content, typically less than about 2.0 wt. % of the solid carbonaceous fuel and commonly about 0.2 wt. %–1.0 wt. %, say about 0.6 wt. %;

(ii) a low iron content, typically less than about 10.0 wt. %, such as about 1.5–8 wt. % of the noncombustible portion of the solid carbonaceous fuel; and (iii) a low calcium content, typically less than about 8.0 wt. %, such as about 1.5–6.5 wt. %, of the noncombustible portion of the solid carbonaceous fuel.

The sulfur content is determined by ultimate analysis of the solid carbonaceous fuel such as provided in ASTM Method D-3177; the iron and calcium contents may be determined after subjecting the ash to ASTM Method D-2795. Illustrative solid carbonaceous fuels which may be combined with other ingredients as feedstock for the subject process have the characteristics shown in Table I below.

TABLE I

| Type of Solid Fuel | Sulfur In Solid Fuel Wt. % | Ash In Solid Fuel Wt. % | Iron In Ash From Solid Fuel Wt. % | Calcium In Ash From Solid Fuel Wt. % | Fluid Temp. of Ash From Solid Fuel °F. |
|---|---|---|---|---|---|
| Lake DeSemet Coal | 1.27 | 30.71 | 7.46 | 5.13 | 2655 |
| Australian Moura Coal | 0.42 | 12.35 | 8.41 | 3.59 | 2739 |
| Australian R.W. Miller Coal | 0.70 | 17.11 | 1.98 | 1.15 | >2800 |

In the process, a modified fuel mixture is produced by mixing together a solid carbonaceous fuel feed which is low in sulfur, iron and calcium with a sufficient amount of an iron sulfide containing material or with supplemental iron and sulfur containing reactant materials that react in the reaction zone of the gas generator to produce iron and sulfur containing compounds. Iron and sulfur containing compounds may then combine with the fuel ash. By this process the fusion temperature of the ash material is lowered in situ, e.g., within the free-flow reaction zone of the partial oxidation gas generator. The ingredients for the modified fuel mixture may be separately ground to the same or to a different particle size range and then mixed together. Alternatively, prior to being comminuted or ground to the same particle size range the ingredients may be mixed together. For example, after all of the ingredients are mixed together, the modified fuel mixture may be ground to a particle size so that at least 85 wt. % of the mixture has a particle size of about 420 microns or smaller. The solid materials may be ground in a conventional ball or rod mill, or the like.

An example of the effect of $FeS_2$ (pyrite) addition on the ash fusion temperature of various coals in which the sulfur, iron and calcium contents are low is shown in Table II.

TABLE II

| Coal Type | Additive | Iron In The Ash Wt. % | Fusion Temperature °F. ASTM D1859 Initial | Softening | Hemisphere | Fluid |
|---|---|---|---|---|---|---|
| Moura Coal | none | 8.41 | 2552 | 2615 | 2661 | 2739 |
| Moura Coal | $FeS_2$ | 16.45 | 2315 | 2475 | 2500 | 2615 |
| R. W. Miller | none | 1.98 | 2659 | >2800 | >2800 | >2800 |
| R. W. Miller | $FeS_2$ | 13.30 | 2015 | — | — | 2680 |

The ground modified solid fuel mixture may be introduced into the gas generator either alone or suspended in a liquid or gaseous medium, e.g., a substantially thermally liquefiable or vaporizable hydrocarbon, water, and mixtures thereof. Vaporizable hydrocarbons include by definition petroleum distillates and residue, oil derived from coal, shale oil, crude petroleum, gas oil, tar sand oil, cycle gas oil from fluid catalytic cracking operation, liquid organic extract of coker gas oil, and mixtures thereof.

In a preferred embodiment, the modified fuel mixture is ground to the proper size and then dispersed in a liquid slurrying medium. A pumpable slurry is formed having a solids content in the range of about 50 to 75 wt. %, such as about 58 to 68wt. %. Optionally, conventional dispersing and/or wetting agents may be added to the slurry including polyelectrolytes. The liquid slurry is then introduced into the reaction zone of the partial oxidation gas generator with or without first being preheated. In another embodiment, to a slurry of one of the ingredients, the remaining ingredients may be added.

Alternatively, the modified fuel mixture of proper particle size may be entrained in a gaseous medium and thereby introduced into the reaction zone of the gas generator. Typical gaseous media include steam, $CO_2$, $N_2$, recycle stream of partially cooled raw effluent gas from the reaction zone, fuel gas, and mixtures thereof.

A typical iron sulfide containing material may be selected from the group consisting of iron sulfide, e.g., pyrite, marcasite, pyrrhotite; coal wash tailings containing iron sulfide, and mixtures thereof. The supplemental iron sulfide containing material may comprise from about 10 to 100 wt. % iron sulfide, such as about 25 to 75 wt. %.

Typical iron containing reactant materials may be selected from the group consisting of iron, iron oxide, iron carbonate, iron silicate, and mixtures thereof. The supplemental iron containing reactant material may comprise from about 10 to 100 wt. % iron, such as about 25 to 75 wt. %. In one embodiment, the iron containing reactant materials are provided as an aqueous solution. Suitable water soluble iron compounds may be selected from the group consisting of ferrous sulfate, iron chloride, ferric nitrate, iron napththenate, iron cyanide, and mixtures thereof.

Typical sulfur containing reactant materials may be selected from the group consisting of free sulfur, $H_2S$, $SO_2$, $SO_3$, sulfuric acid, higher sulfur containing carbonaceous feedstock, sulfuric acid recovery process sludge, sulfonation sludge, and mixtures thereof. The supplemental sulfur containing reactant materials may comprise from about 10 to 100 wt. % sulfur, such as about 25 to 75 wt. %.

A supplemental temperature moderator to moderate the temperature in the reaction zone may be optionally used. A temperature moderator is not generally required with water slurries. Suitable temperature moderators include superheated steam, saturated steam, unsaturated steam, water, $CO_2$-rich gas, a portion of the cooled exhaust from a turbine employed downstream in the process, nitrogen in air, by-product nitrogen from a conventional air separation unit, or cooled synthesis gas and mixtures of the aforesaid temperature moderators. The temperature moderator may be introduced in admixture with either the solid fuel mixture, the free-oxygen containing gas, or both. Alternatively, the temperature moderator may be introduced into the reaction zone of the gas generator by way of a separate conduit in the burner.

The term free-oxygen containing gas, as used herein is intended to include air, oxygen-enriched air, i.e. greater than 21 mole % oxygen, and substantially pure oxygen, i.e. greater than 95 mole % oxygen, (the remainder comprising $N_2$ and rare gases). Free-oxygen containing gas may be introduced into the burner at a temperature in the range of about ambient to 1300° F.

Any conventional means may be used for introducing the modified fuel mixture into the reaction zone of a free-flow partial oxidation gas generator. For example, a suitable burner is shown in coassigned U.S. Pat. No. 4,443,230. An extruder for feeding finely divided solids into a gasifier is shown in coassigned U.S. Pat. No. 4,218,222. Conventional partial oxidation reactors may be used in the subject process. A suitable partial oxidation apparatus is shown in coassigned U.S. Pat. No. 4,289,502. The later three coassigned U.S. Patents are incorporated herein by reference.

The partial oxidation reaction takes place within the free-flow refractory lined reaction zone of the gas generator at a temperature greater than about 2000° F. and high enough to keep the ash produced in the molten state. Preferably, the temperature in the reaction zone is below 2700° F. The pressure is in the range of about 1 to 200 atmospheres. The ratio of the atoms of free-oxygen containing gas plus the atoms of organically combined oxygen in the solid carbonaceous fuel per atom of carbon in the solid carbonaceous fuel (O/C atomic ratio) may be in the range of about 0.7 to 1.6, such as about 0.9 to 1.1. With water as the temperature moderator, the weight ratio of $H_2O$ to the solid carbonaceous fuel feed is in the range of about 0.33 to 1.0, such as about 0.47 to 0.72. A raw effluent stream of synthesis gas, reducing gas, or fuel gas leaving the reaction zone of the free-flow gas generator comprises the following in mole % dry basis with substantially pure oxygen feed: $H_2$ 25 to 50, CO 30 to 55, $CO_2$ 5 to 25, $CH_4$ nil to 3, $H_2S+COS$ 0.5 to 5, $N_2$ nil to 5.0, Ar nil to 1.5, $NH_3$ nil to 1, entrained particulate matter, e.g. particulate carbon soot, and molten ash containing iron and sulfur containing compounds. $H_2O$, as steam, is always present in the raw effluent gas stream.

In the subject invention, sufficient iron and sulfur are present with the solid carbonaceous fuel so that the melting point of the ash entrained in the raw effluent gas stream leaving the reaction zone is reduced. Further, excess $H_2S$ is present in the reaction zone so that no free iron is present. The mole ratio $H_2S/H_2+CO$ in the raw gas stream is greater than 0.01, such as in the range of about 0.015 to 0.05. The amount of iron in the molten ash is greater than 10.0 wt. % of the molten ash, and preferably at least equivalent to 14.0 wt. % of the molten ash. The amount of iron and sulfur in the molten ash will enhance the low temperature fluidity properties of the molten ash entrained in the raw effluent gas stream. By the subject process, the fluid temperature of the molten ash entrained in the raw effluent gas stream is reduced below the fluid temperature of the ash in the solid carbonaceous fuel. For example, the fluid temperature of the molten ash may be at least about 100° F., such as about 100° F. to 350° F. or more below the fluid temperature of the ash in the solid carbonaceous fuel feed. This allows the gas generator to be operated at a temperature below the fluid temperature of the ash in the solid carbonaceous fuel feed. For example, the gas generator may be operated at a temperature in the range of about 2000° F. to below 2700° F. such as about 2300° F. to 2600° F., and at a pressure in the range of about 1 to 200 atmospheres, such as about 10 to 100 atmospheres, while still providing molten slag with sufficient fluidity for trouble-free draw-off. Advantageously, by operating at a lower temperature the refractory life in the gasifier is extended.

The hot raw effluent gas stream is discharged from the reaction zone, preferably downward through a bottom outlet located along the central longitudinal axis of the gas generator and then cooled and cleaned. Any suitable method or combination of methods for cooling the raw gas stream and removing at least a portion, e.g., about 10 to 100 wt. % of the entrained particulate matter and molten ash may be used. In a preferred embodiment, all of the hot raw effluent gas stream from the reaction zone may be quench cooled and cleaned by being passed through a dip tube that terminates beneath the surface of a pool of quench water contained in the bottom of a quench tank located below the reaction zone. A typical quench tank is shown in coassigned U.S. Pat. No. 4,218,423, which is incorporated herein by reference. The particles of molten slag solidify in the quench water and are separated from the raw gas stream along with the other particulate solids, e.g. carbon, soot by the turbulence created when the effluent gas stream passes through the body of quench water. The cooled and at least partially cleaned raw effluent gas stream is then discharged through an outlet in the side wall near the top of the quench tank. The solidified slag particles may be then removed along with some quench water through an outlet in the bottom of the quench tank and a lockhopper system such as shown in coassigned U.S. Pat. No. 4,247,302. This later reference, as well as coassigned U.S. Pat. Nos. 4,328,006 and 4,377,132 depict other typical processes and apparatus for cooling the raw gas stream from the partial oxidation gas generator by indirect heat exchange, and separating combustion residue, e.g. molten slag and/or particulate solids from the gas stream. These coassigned U.S. Patents are incorporated herein by reference.

The quench cooled and at least partially cleaned raw gas stream may be further cleaned in a conventional gas scrubbing zone by being contacted with scrubbing liquid, typically water, at a temperature in the range of about 300° F.–500° F., say about 400° F. During gas quenching and scrubbing, the raw gas picks up water vapor so that the mole ratio of raw gas to water, may be in the range of about 0.5–2:1, say about 1:1.

The raw gas stream exiting the gas scrubber can be further processed by water-gas shift conversion to produce hydrogen. Alternatively, the gas can be used as fuel gas, reducing gas or for chemical synthesis. $H_2S$ and COS in the cleaned raw gas stream may be removed by conventional processing, e.g., rectisol, selexol, sulfinol. These sulfur containing gases can be then further processed in a Claus unit to recover by-product elemental sulfur. A major portion of the sulfur may be derived from coal wash tailings that may be used as an additive to the coal charge. Alternatively, the sulfur containing gases may be introduced directly into the gas generator as the sulfur containing reactant material.

Advantageously, the subject process permits the disposal of coal wash tailings containing iron sulfide in an environmentally acceptable manner while lowering the fluid temperature of ash from coals whose ash has a naturally high fluid temperature. This permits operation of the gas generator at lower temperatures and prolongs the life of the refractory lining the reaction zone. Further, it permits the recovery of sulfur (a commercially valuable by-product) from coal wash tailings which are ordinarily a waste product.

Although this invention has been illustrated by reference to specific embodiments, it will be apparent to those skilled in the art that various changes and modifications may be made which clearly fall within the scope of this invention.

We claim:

1. A partial oxidation process comprising: (1) mixing together an ash-containing solid carbonaceous fuel containing less than about 2.0 wt. % sulfur, and in the non-combustible portion of said solid carbonaceous fuel less than 10 wt. % iron and less than about 8.0 wt. % of calcium with a sufficient amount of an ash-combining agent comprising iron sulfide containing material or supplemental iron containing reactant materials and sulfur containing reactant materials that react in the reaction zone in (2) to produce iron containing compounds and sulfur containing compounds that combine with the fuel ash; (2) reacting said mixture of materials optionally suspended in a liquid or gaseous medium by partial oxidation with a free-oxygen containing gas in the presence of $H_2O$ in a free-flow reaction zone in a reducing atmosphere at a temperature greater than about 2000° F. and below the fluid temperature of the ash in the solid carbonaceous fuel feed to the reaction zone and high enough to keep the ash produced in the molten state, and a pressure in the range of about 1 to 200 atmospheres, wherein the weight ratio of $H_2O$ to the solid carbonaceous fuel is in the range of about 0.33 to 1.0, to produce a raw effluent gas stream which is discharged downward through a bottom outlet in the reaction zone and which substantially comprises $H_2$, CO, $CO_2$, $H_2O$, $H_2S$, COS, entrained particulate matter including molten ash containing iron compounds whose iron content is greater than 10 wt. % of the molten ash, and optionally at least one material from the group $CH_4$, $N_2$, Ar, and $NH_3$; wherein sufficient iron and sulfur are in the reaction zone so that the melting point of the solid carbonaceous fuel ash is decreased and the fluid temperature of the molten ash entrained in the raw gas stream is reduced about 100° F. or more below the fluid temperature of the ash in the solid carbonaceous fuel without the addition of said ash-combining agent; excess $H_2S$ is present in the reaction zone and no free iron remains, and the mole ratio $H_2S/H_2+CO$ in the raw gas stream is greater than 0.01; and (3) separating at least a portion of said particulate matter and molten ash from the raw gas stream.

2. The process of claim 1 wherein the iron content of the molten ash produced in step (2) is at least equivalent to 14.0 wt. % of the molten ash.

3. The process of claim 1 wherein prior, during, or subsequent to being mixed with said iron sulfide containing material or supplemental iron and sulfur containing reactant materials that react in the reaction zone in step (2) to produce iron and sulfur containing compounds, said solid carbonaceous fuel is ground so that at least 85 wt. % has a particle size of about 420 microns or smaller.

4. The process of claim 1 provided with the step of separating said $H_2S$ and COS from the raw gas stream in a gas purification zone.

5. The process of claim 4 provided with the step of recycling at least a portion of said separated $H_2S$ and COS back to step (1) as at least a portion of said sulfur containing reactant material.

6. The process of claim 4 provided with the step of processing said separated $H_2S$ and COS in a Claus unit to produce elemental sulfur.

7. The process of claim 1 wherein said iron sulfide containing material is selected from the group consisting of iron sulfide, coal cleaning waste products containing iron sulfide, and mixtures thereof.

8. The process of claim 1 wherein said iron containing reactant materials are selected from the group consisting of iron, iron oxide, iron carbonate, iron silicate, and mixtures thereof.

9. The process of claim 1 wherein said iron containing reactant materials are provided as an aqueous solution.

10. The process of claim 1 wherein said iron containing reactant materials are provided as a water soluble compound selected from the group consisting of ferrous sulfate, iron chloride, ferric nitrate, iron naphthenate, iron cyanides, and mixtures thereof.

11. The process of claim 1 wherein said sulfur containing reactant materials are selected from the group consisting of free sulfur, $H_2S$, $SO_2$, $SO_3$, sulfuric acid, high sulfur containing carbonaceous feedstock, sulfuric acid recovery process sludge, sulfonation sludge, and mixtures thereof.

12. The process of claim 1 wherein said solid carbonaceous fuel is selected from the group consisting of coals including anthracite, bituminous, sub-bituminous, lignite; coke from coal; petroleum coke; soot; tar sand; asphalt; pitch; and mixtures thereof.

13. The process of claim 1 wherein the partial oxidation reaction in (2) takes place in the presence of a supplemental temperature moderator.

14. The process of claim 13 wherein a supplemental temperature moderator is selected from the group consisting of steam, water, $CO_2$-rich gas, a portion of the cooled exhaust from a turbine employed downstream in the process, nitrogen, cooled synthesis gas and mixtures thereof.

15. The process of claim 1 wherein said mixture of materials in (1) is suspended in a liquid medium selected from the group consisting of a substantially thermally liquefiable or vaporizable hydrocarbon, water, and mixtures thereof.

16. The process of claim 1 wherein said mixture of materials in (1) is suspended in a gaseous medium selected from the group consisting of steam, $CO_2$, $N_2$, recycle stream of partially cooled raw effluent gas from the reaction zone, fuel gas, and mixtures thereof.

17. The process of claim 1 wherein said mixture of materials in (1) is introduced into the reaction zone in (2) as a pumpable slurry having a solids content in the range of about 50 to 75 wt. %.

18. The process of claim 17 wherein said slurry comprises said mixture of materials dispersed in a liquid slurrying medium selected from the group consisting of water, liquid hydrocarbon fuel, and mixtures thereof.

19. The process of claim 17 wherein said slurry includes dispersing and/or wetting agents.

* * * * *